US007703772B2

(12) United States Patent
Morikawa et al.

(10) Patent No.: US 7,703,772 B2
(45) Date of Patent: Apr. 27, 2010

(54) PRIZE DISPENSING MECHANISM AND GAME DEVICE

(75) Inventors: Hironobu Morikawa, Tokyo (JP); Shigeharu Goto, Kanagawa (JP)

(73) Assignee: Namco Bandai Games Inc., Tokyo (JP)

( * ) Notice: Subject to any disclaimer, the term of this patent is extended or adjusted under 35 U.S.C. 154(b) by 519 days.

(21) Appl. No.: 11/705,068

(22) Filed: Feb. 12, 2007

(65) Prior Publication Data

US 2007/0200289 A1 Aug. 30, 2007

(30) Foreign Application Priority Data

Feb. 15, 2006 (JP) ..... 2006-038122

(51) Int. Cl.
*A63B 67/00* (2006.01)

(52) U.S. Cl. ..... 273/440; 273/441; 273/447; 273/448; 273/454; 221/92; 221/93; 221/94; 221/95; 221/133; D20/1; D20/4; D20/8; D20/9; 248/674; 463/7

(58) Field of Classification Search ..... 273/120 A, 273/441, 454, 447, 440, 448; 248/674; 221/92–95, 221/133; D20/1, 4, 8–9; 463/7
See application file for complete search history.

(56) References Cited

U.S. PATENT DOCUMENTS 5,368,310 A * 11/1994 Ogata et al. ..... 273/448
5,507,490 A * 4/1996 Hagiwara ..... 463/16
5,553,865 A * 9/1996 Shoemaker et al. ..... 273/448
5,667,218 A * 9/1997 Kumabe et al. ..... 273/138.3
5,713,572 A * 2/1998 Hagiwara ..... 273/138.3
5,741,013 A * 4/1998 Hamano et al. ..... 273/447
5,855,374 A * 1/1999 Shoemaker, Jr. ..... 273/447
6,062,567 A * 5/2000 Uetono et al. ..... 273/447
6,095,731 A * 8/2000 Minakami et al. ..... 410/20
6,598,881 B1 * 7/2003 Shoemaker, Jr. ..... 273/447
6,634,940 B2 * 10/2003 Yoshida et al. ..... 463/7
6,695,698 B1 * 2/2004 Anghelo et al. ..... 463/25
2002/0067002 A1 * 6/2002 Yoshida et al. ..... 273/447
2003/0020234 A1 * 1/2003 Jordan ..... 273/138.3
2003/0073479 A1 * 4/2003 Wilson et al. ..... 463/16
2003/0151202 A1 * 8/2003 Fisher et al. ..... 273/447

(Continued)

FOREIGN PATENT DOCUMENTS

JP B2 3372508 11/2002

*Primary Examiner*—Gene Kim
*Assistant Examiner*—Alexander R Niconovich
(74) *Attorney, Agent, or Firm*—Oliff & Berridge, PLC

(57) ABSTRACT

A pusher-type prize dispensing device in which each of two support plates on which a bonus prize is placed is pivotally supported on one end on an axis of which the axial direction coincides with the horizontal and depth direction, and is locked almost horizontally by allowing the other end to be suspended on a locking member. A suspended string is tied to a bent upper portion, and the other end of the support plate is suspended on the top surface of a lower portion, whereby the locking member locks the support plate. When a weight member falls from a stationary table, the locking member moves rotationally due to the fall of the weight member so that the upper portion moves downward, whereby the support plate falls downward, causing the prize P placed on the top surface of the support plate to fall toward a prize receiving port.

10 Claims, 9 Drawing Sheets

U.S. PATENT DOCUMENTS

2004/0036224 A1* 2/2004 Crompton ..... 273/454
2005/0046106 A1* 3/2005 Ohara et al. ..... 273/138.1
2005/0087926 A1* 4/2005 Hattori ..... 273/138.3
2006/0027973 A1* 2/2006 Nireki et al. ..... 273/440
2007/0029734 A1* 2/2007 Fukazawa et al. ..... 273/447
2007/0126185 A1* 6/2007 Fukuzawa et al. ..... 273/447
2007/0200289 A1* 8/2007 Morikawa et al. ..... 273/120 A
2007/0296146 A1* 12/2007 Omoto et al. ..... 273/138.3
2008/0090629 A1* 4/2008 Matsuda et al. ..... 463/7

* cited by examiner

PRIZE DISPENSING MECHANISM AND GAME DEVICE

Japanese Patent Application No. 2006-038122 filed on Feb. 15, 2006, is hereby incorporated by reference in its entirety.

BACKGROUND OF THE INVENTION

The present invention relates to a pusher-type game device and a prize dispensing mechanism used for the game device.

A pusher-type prize dispensing game machine has been known as one type of game device. The pusher-type prize dispensing game machine includes a shovel which picks up a prize placed on a rotating turntable, a stationary table, and a slide table which moves on the stationary table to approach or move away from a prize receiving port. When the player inputs start instructions, the shovel automatically picks up the prize from the turntable. When the player inputs drop instructions, the shovel drops the picked-up prize onto the stationary table. The prize dropped onto the stationary table is pushed by other prizes by being pushed by the slide table, and finally falls from the stationary table. When the fallen prize successfully enters the prize receiving port, the player can acquire the prize. The pusher-type prize dispensing game machine is particularly popular among women and children as a game which allows everyone to enjoy it due to the simple rule.

A pusher-type prize dispensing game machine has been known which includes a prize storage section inclinably provided above the prize receiving port and a weight member coupled to the prize storage section and placed on the stationary table. In more detail, the opening of a bucket, which stores the prize and is suspended above the prize receiving port, and the weight member on the stationary table are connected with a string. In this case, when the weight member is pushed and falls in the same manner as the prize on the stationary table, the storage section coupled to the weight member is inclined due to the fall of the weight member, whereby the prize which has been stored falls into the prize receiving port. The above configuration, in which the bonus prize is separately stored and dispensed when specific conditions have been satisfied, improves the player's fondness for speculation that a large number of prizes can be acquired at one time, whereby the interest in the game can be improved (see Japanese Patent No. 3372508, for example).

Since the above mechanism, in which the prize which has been stored is dropped into the outlet and dispensed when specific conditions have been satisfied, becomes familiar with time, the player loses interest in the mechanism, whereby the objective of increasing the motivation to play cannot be achieved. Therefore, a novel mechanism is always demanded.

SUMMARY

According to one aspect of the invention, there is provided a prize dispensing mechanism used for a pusher-type game device which dispenses a prize which has been pushed from a stationary table and falls into a prize receiving port, the prize dispensing mechanism comprising:

a support plate for placing the prize, the support plate being pivotally supported on a specific horizontal axis;

a locking member pivotally supported on a specific axis and having on one end a suspension section on which an end of the support plate is suspended, the locking member preventing downward rotational movement of the support plate by allowing the support plate to be suspended on the suspension section; and an external force applying mechanism which applies external force to the other end of the locking member;

wherein the locking member moves rotationally when the external force is applied to the other end of the locking member by the external force applying mechanism to release the lock of the locking member, whereby the support plate moves rotationally and the prize placed on the support plate falls.

According to another aspect of the invention, there is provided a pusher-type game device which dispenses a prize which has been pushed from a stationary table and falls into a prize receiving port, the game device comprising:

a support plate for placing the prize, the support plate being pivotally supported on a specific horizontal axis;

a locking member pivotally supported on a specific axis and having on one end a suspension section on which an end of the support plate is suspended, the locking member preventing downward rotational movement of the support plate by allowing the support plate to be suspended on the suspension section;

a prize box which can store the prize therein; and a support arm which supports the prize box on one end and is pivotally supported on the other end, the support arm being able to transition between an upright state and an inclined state;

wherein the support arm rotates and inclines so that the prize box touches the other end of the locking member to apply external force, whereby the locking member moves rotationally to release the lock of the locking member so that the support plate moves rotationally, whereby the prize placed on the support plate falls.

DETAILED DESCRIPTION OF THE EMBODIMENT

Figure 1:
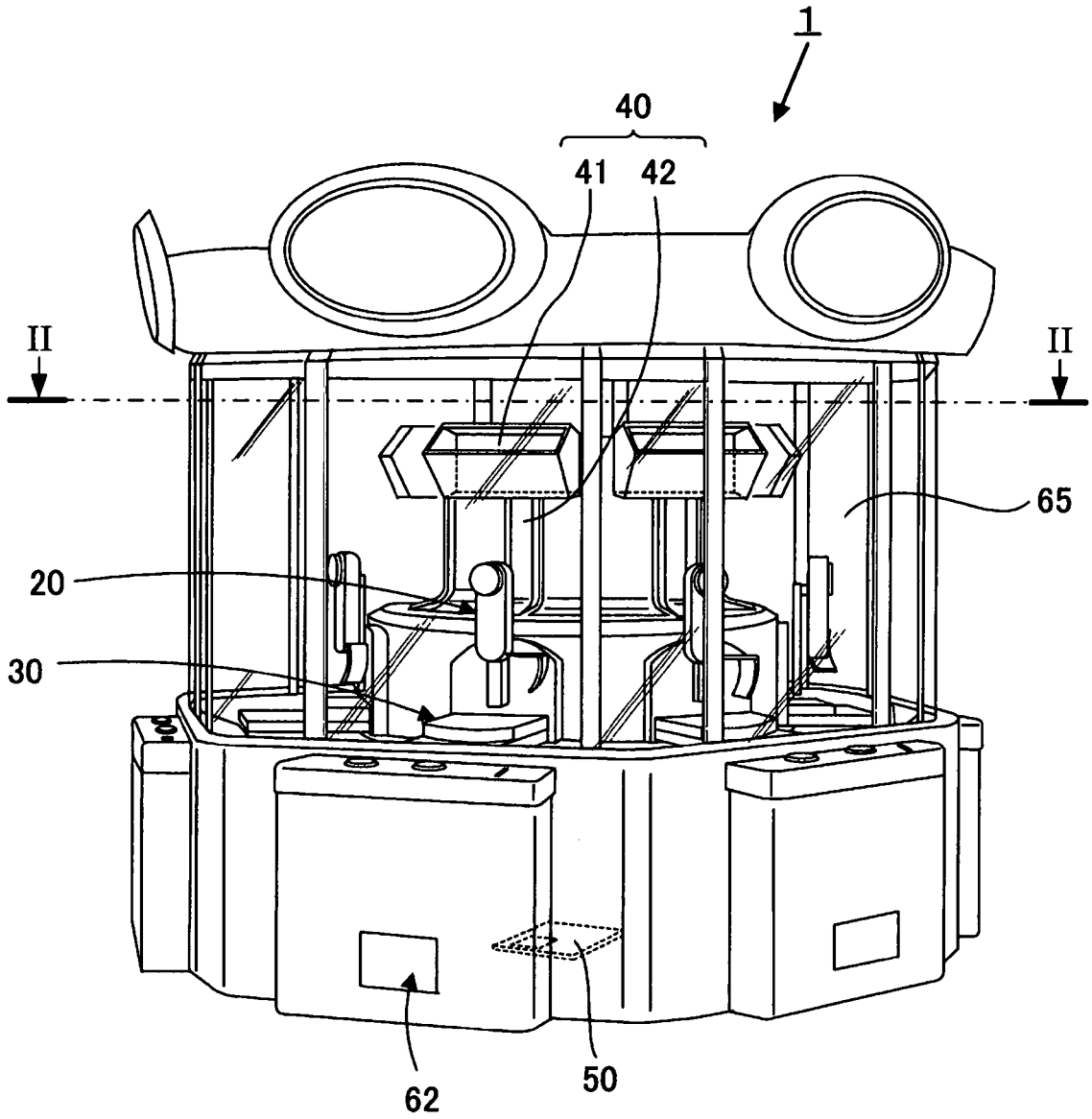
FIG. 1 is an outside view of a game device.

The invention may provide a novel mechanism which dispenses a prize stored in advance.

According to one embodiment of the invention, there is provided a prize dispensing mechanism used for a pusher-type game device which dispenses a prize which has been pushed from a stationary table and falls into a prize receiving port, the prize dispensing mechanism comprising:

a support plate for placing the prize, the support plate being pivotally supported on a specific horizontal axis;

a locking member pivotally supported on a specific axis and having on one end a suspension section on which an end of the support plate is suspended, the locking member preventing downward rotational movement of the support plate by allowing the support plate to be suspended on the suspension section; and an external force applying mechanism which applies external force to the other end of the locking member;

wherein the locking member moves rotationally when the external force is applied to the other end of the locking member by the external force applying mechanism to release the lock of the locking member, whereby the support plate moves rotationally and the prize placed on the support plate falls.

In the prize dispensing mechanism used for a pusher-type game device according to this embodiment, the end of the support plate pivotally supported on the horizontal axis is suspended and locked on the suspension section of the locking member pivotally supported on the specific axis, whereby the downward rotational movement of the support plate is prevented. When external force is applied to the other end of the locking member due to the external force applying mechanism, the locking member moves rotationally, whereby the lock is released to cause the support plate to move rotationally, whereby the prize placed on the support plate falls. Therefore, disposing the support plate above and near the prize receiving port and locking the support plate so that the prize can be placed on the support plate allows a novel prize dispensing mechanism to be realized in which the locking member moves rotationally when external force is applied to the other end of the locking member, whereby the lock of the support plate is released, causing the support plate to move rotationally, whereby the stored prize is dispensed.

In the prize dispensing mechanism, the external force applying mechanism includes a weight member which is coupled to the other end of the locking member and is placed on the stationary table; and force occurring when the weight member falls from the stationary table is transmitted to the other end of the locking member, whereby the locking member moves rotationally.

According to this feature, when the weight member coupled to the other end of the locking member is placed on the stationary table and falls from the stationary table, the support plate moves rotationally due to release of the lock, whereby the prize placed on the support plate falls. This realizes a novel prize dispensing mechanism in which, when the weight member falls from the stationary table, the locking member moves rotationally, whereby the lock is released to cause the support plate to move rotationally, whereby the prize placed on the support plate falls.

In the prize dispensing mechanism, the locking member is pivotally supported on a horizontal axis to move rotationally in a vertical direction in a state in which the one end is positioned on a lower side and the other end is positioned on an upper side; and a notch is formed in the suspension section in which a suspended string which connects the other end and the weight member moves freely.

According to this feature, the locking member is pivotally supported on the horizontal axis to move rotationally in the vertical direction in a state in which one end having the suspension section is positioned on the lower side and the other end coupled to the weight member is positioned on the upper side, and the notch is formed in the suspension section on the other end in which the suspended string which connects the other end and the weight member moves freely. Specifically, the suspended string tied to the other end of the locking member is suspended downward through the notch formed on one end below the other end and is tied to the weight member on the stationary table in a state in which the support plate is locked. This prevents a situation in which the suspended string is caught by the support plate to prevent the rotational movement of the locking member when the weight member falls from the stationary table, or the rotational movement of the support plate when the lock is released is hindered.

In the prize dispensing mechanism, the locking member is pivotally supported at a specific position between the one end and the other end, and moves rotationally so that the suspension section on the one end moves due to downward external force applied to the other end.

According to this feature, the locking member is pivotally supported at a specific position between one end and the other end, and moves rotationally so that the suspension section on one end moves due to downward external force applied to the other end. Specifically, when the weight member falls from the stationary table, the locking member moves rotationally since the other end of the locking member coupled to the weight member is pulled downward so that the suspension section on one end moves, whereby the end of the support plate suspended on one end is displaced so that the lock of the support plate is released.

In the prize dispensing mechanism, the support plate is suspended on the suspension section when the suspension section is located at a lowermost end of a rotational movement swing, whereby the locking member locks the support plate.

According to this feature, the support plate is suspended when the suspension section is located at the lowermost end on the rotational movement swing, whereby the locking member locks the support plate. When the suspension section is located at the lowermost end on the rotational movement swing, the suspension section of the locking member is located right under the specific axis which pivotally supports the suspension section, for example. In this case, the support plate can be stably locked.

In the prize dispensing mechanism, the locking member is formed so that height of the suspension section can be changed.

This enables the height of the suspension section of the locking member to be changed. Specifically, the suspension position of the support plate can be changed, whereby the inclined plate can be locked in a state in which the prize placed thereon does not slip down.

In the prize dispensing mechanism, the locking member includes a skidproof member provided in a contact section of the suspension section with the support plate.

According to this feature, the skidproof member is provided in the contact portion of the suspension section with support plate. This prevents the support plate which is suspended on the suspension section of the locking member from slipping down, whereby the support plate can be stably locked. As the skidproof member, a material which can improve the friction coefficient between the locking part of the locking member and the end of the support plate, such as a sheet member formed of rubber or the like may be used.

The prize dispensing mechanism comprises:

a plurality of the support plates;

wherein the locking member locks the support plates, and the prizes placed on the support plates fall when the lock is released.

According to this feature, a plurality of the support plates are locked by one locking member, and the prizes placed on the support plates fall when the lock is released.

The prize dispensing mechanism comprises:

a plurality of the locking members;

wherein the support plate moves rotationally when the locks of all of the locking members are released, whereby the prize placed on the support plate falls.

According to this feature, one support plate is locked by a plurality of locking members, and the prize placed on the support plate falls when the locks of all the locking members are released.

According to another embodiment of the invention, there is provided a pusher-type game device which dispenses a prize which has been pushed from a stationary table and falls into a prize receiving port, the game device comprising:

a support plate for placing the prize, the support plate being pivotally supported on a specific horizontal axis;

a locking member pivotally supported on a specific axis and having on one end a suspension section on which an end of the support plate is suspended, the locking member preventing downward rotational movement of the support plate by allowing the support plate to be suspended on the suspension section;

a prize box which can store the prize therein; and a support arm which supports the prize box on one end and is pivotally supported on the other end, the support arm being able to transition between an upright state and an inclined state;

wherein the support arm rotates and inclines so that the prize box touches the other end of the locking member to apply external force, whereby the locking member moves rotationally to release the lock of the locking member so that the support plate moves rotationally, whereby the prize placed on the support plate falls.

In the pusher-type game device according to this embodiment, the end of the support plate pivotally supported on the horizontal axis is suspended and locked on the suspension section of the locking member pivotally supported on the specific axis, whereby the downward rotational movement of the support plate is prevented. The prize box is supported by the rotatable support arm. When the support arm rotates and inclines, the prize box touches the other end of the locking member due to external force so that the locking member moves rotationally, whereby the lock is released to cause the support plate to move rotationally, causing the prize placed on the support plate to fall. Therefore, disposing the support plate above and near the prize receiving port and locking the support plate so that the prize can be placed on the support plate allows a novel prize dispensing mechanism to be realized in which the prize box touches the other end of the locking member when the support arm rotates and inclines to apply external force, whereby the locking member moves rotationally to release the lock of the support plate, whereby the support plate moves rotationally so that the stored prize is dispensed.

In the game device further comprises:

a control section which controls rotation of the support arm.

According to this feature, rotation of the support arm, that is, release of the lock of the support plate can be controlled.

Preferred embodiments of the invention are described below with reference to the drawings.

<Game Device>

Figure 2:
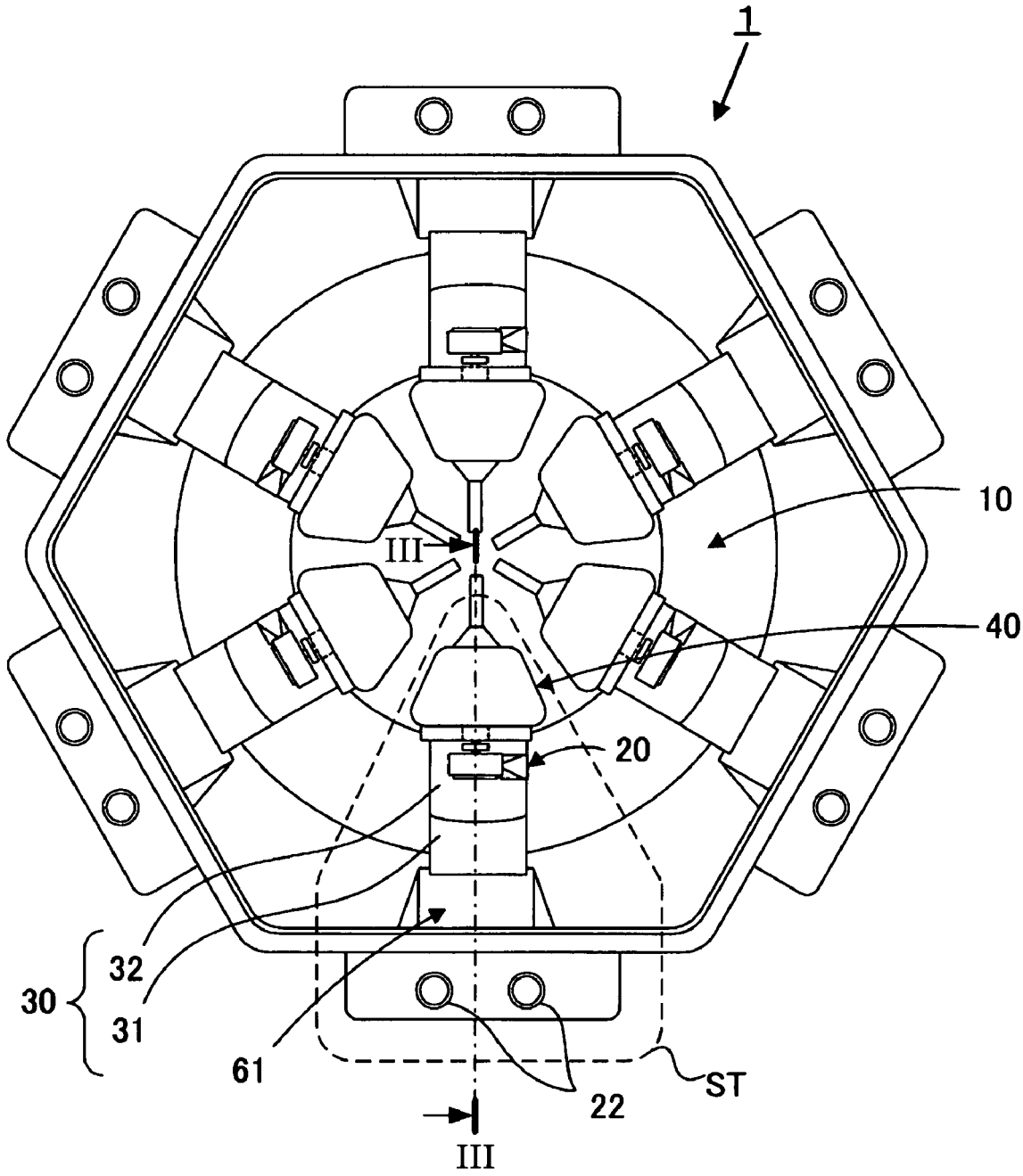
FIG. 2 is a plan view of a game device.

FIG. 1 is an outside view of a game device 1 according to this embodiment. FIG. 2 is a cross-sectional view along the line II-II in FIG. 1. The game device 1 is an arcade game device which is called a pusher-type game device and is mainly installed in a shop such as a game arcade.

As shown in FIGS. 1 and 2, the game device 1 includes a turntable 10 on which a number of prizes P are disposed, a pick-up device 20 which picks up the prize P disposed on the turntable 10, an operation switch 22 for the pick-up device 20, a pusher table section 30 on which the prize P picked up by the pick-up device 20 is placed and which pushes and drops the prize P into a prize receiving port 61, a jackpot (JP) dispensing device 40 which dispenses a bonus prize P when specific conditions have been satisfied, and a control device 50 which integrally controls the game device 1. The upper part of the side surface of the housing of the game device 1 is covered with a transparent cover 65 formed of a transparent acrylic plate so that the inside of the game device 1 can be observed.

The game device 1 is in an approximately hexagonal shape in plan view, and six stations ST for players to play are provided on the respective sides of the approximately hexagonal shape. The pick-up device 20, the operation switch 22, the pusher table section 30, the JP dispensing device 40, and a prize dispensing port 62 which communicates with the prize receiving port 61 for removing the prize P are provided for each station ST. Therefore, six players can simultaneously enjoy the game at the respective stations ST.

The directions referred to in the following description are defined as follows. Specifically, the vertical and horizontal directions are as shown in FIG. 1, and the depth direction is the direction from each station ST to the center of the game device 1 (i.e. front-to-back direction). Specifically, the vertical and horizontal directions and the depth direction used herein refer to the directions viewed from the player who plays at each station ST.

The turntable 10 has a circular groove which opens upward, and a number of prizes P are disposed on the bottom surface of the groove. The turntable 10 slowly rotates inside the game device 1 in a specific direction around the approximate center of the game device 1.

The pick-up device 20 includes two shovel arms and a shovel having a curved surface which allows the prize P to be picked up, and a specific link mechanism is formed by the two shovel arms and the shovel. The pick-up device 20 performs a series of pick-up operations including driving the shovel arm according to an operation signal from the operation switch 22, picking up the prize on the turntable 10 using the shovel, and dropping the picked-up prize P onto the pusher table section 30 under control of the control device 50.

The pusher table section 30 includes a stationary table 31 and a slide table 32. The stationary table 31 is a flat plate which extends above the turntable 10 from the center of the device to the outside. The front end of the stationary table 31 is positioned above the prize receiving port 61. The slide table 32 is a flat plate which silidingly reciprocates back and forth along the top surface of the stationary table 31. The prize P placed on the stationary table 31 is moved by being pushed by the front face of the slide table 32 due to the reciprocating motion of the slide table 32. When the prizes P are placed on the stationary table 31 at a high density, a single prize P is pushed by other prizes P and falls from the front end of the stationary table 31 into the prize receiving port 61, whereby the prize P is dispensed from the prize dispensing port 62. When the prizes P are placed on the stationary table 31 at a low density, the individual prizes P move to fill the space on the stationary table 31.

The JP dispensing device 40 includes a JP (jackpot) box 41 in which a JP prize P is stored in advance, and a support arm 42 which supports the JP box 41 at one end. The JP dispensing device 40 can change the position of the JP box 41 by allowing the support arm 42 to rotate around the other end. The JP dispensing device 40 is normally in a state in which the support arm 42 almost stands upright to position the JP box 41 at the center of the device. When specific JP conditions have been satisfied, the support arm 42 inclines toward the front side (player side), whereby the prize P stored in the JP box 41 drops. Rotation of the support arm 42 is controlled by the control device 50 so that the support arm 42 can be stopped at an arbitrary position between the upright state and the inclined state.

<Prize Dispensing Device>

Figure 3:
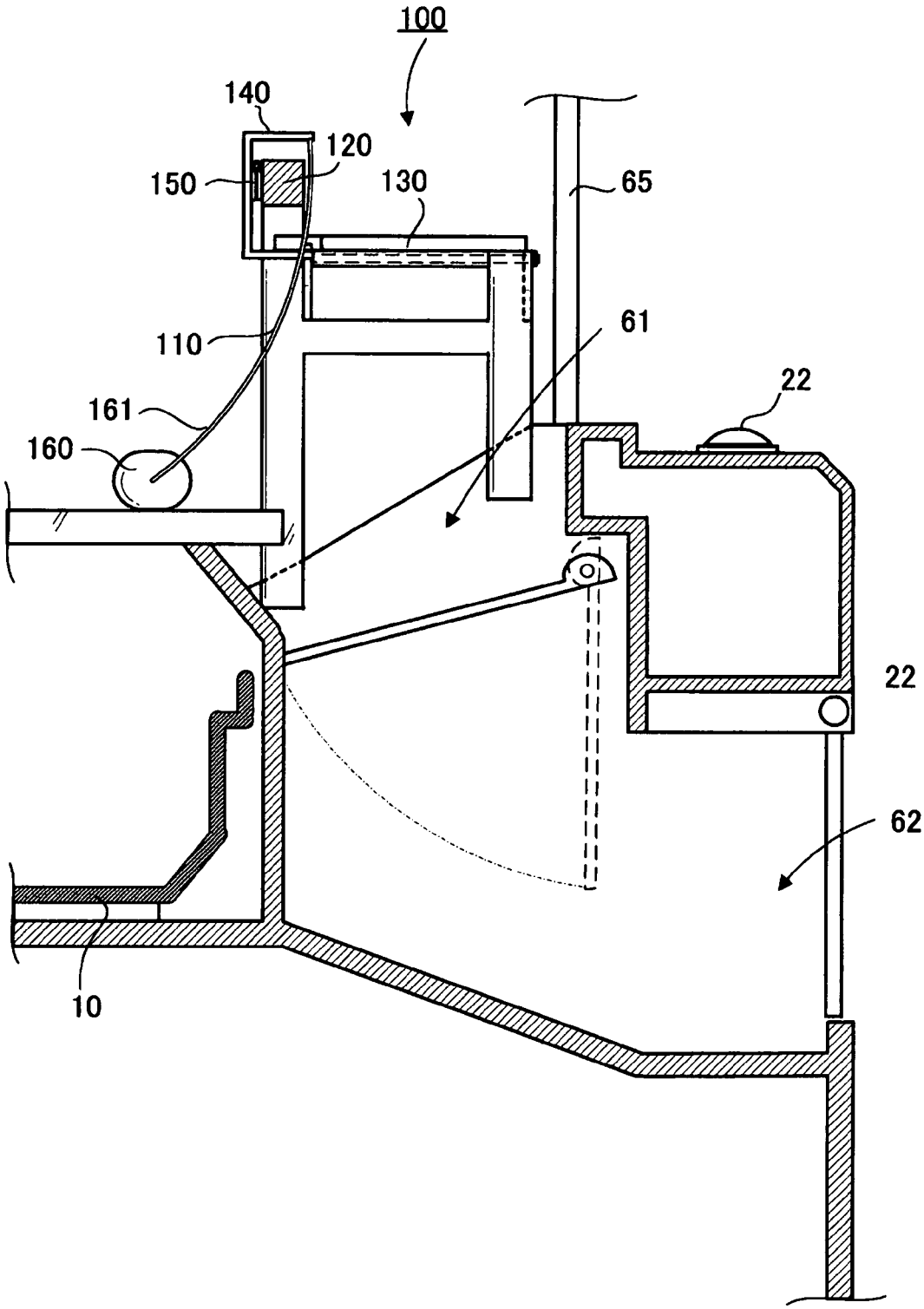
FIG. 3 is a vertical cross-sectional view of a station.

FIG. 3 is a cross-sectional view of the main portion shown in FIG. 2 along the line III-III. FIG. 3 shows the case where the prize dispensing device 100 is disposed above the prize dispensing port 61. In this embodiment, the prize dispensing device 100 is provided at each station ST, as shown in FIG. 3. The prize dispensing device 100 is a device which dispenses the prize P stored on a support plate 130 in advance when a weight member 160 falls from the stationary table 31.

Figure 4:
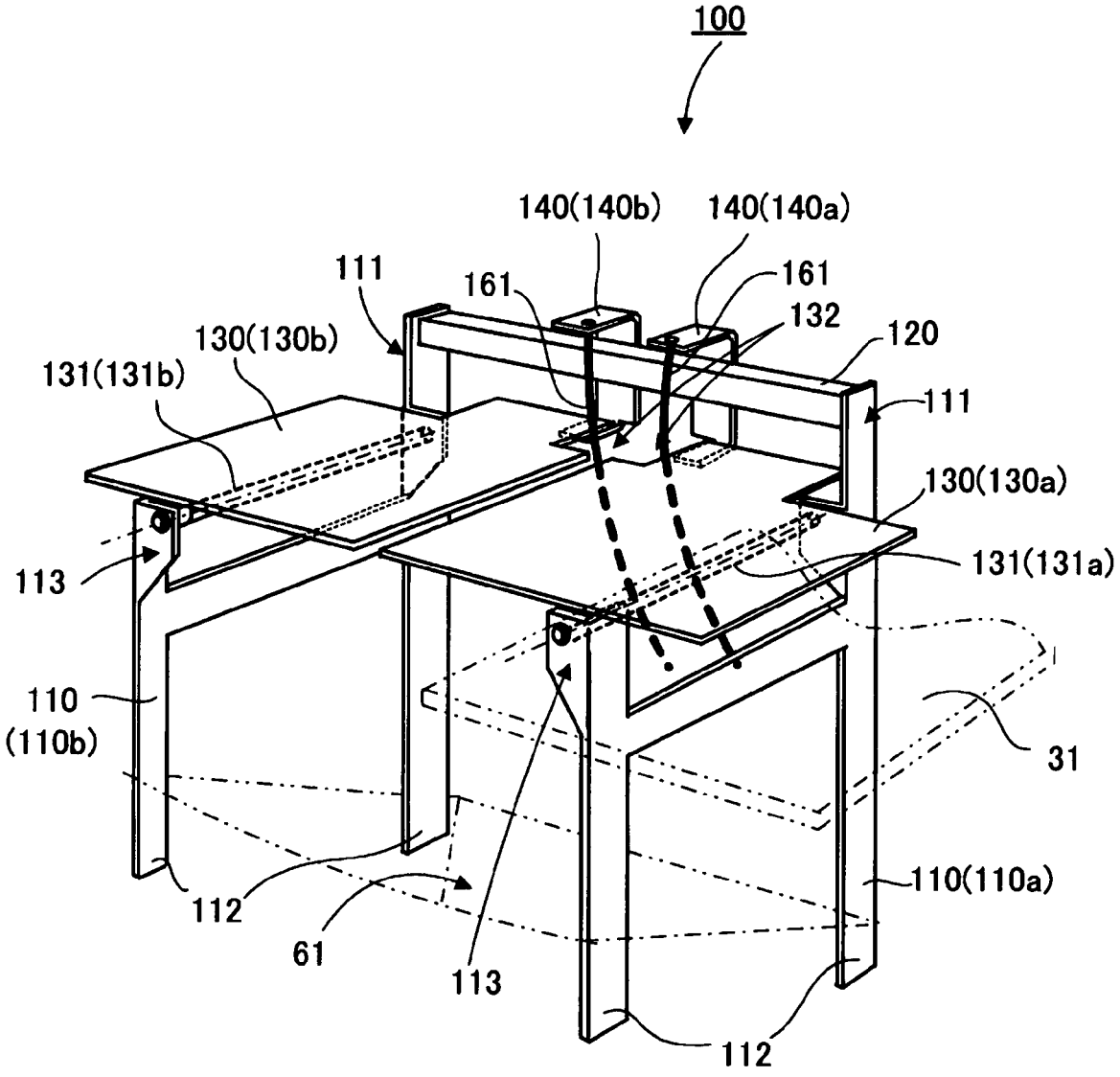
FIG. 4 is an oblique view of a prize dispensing device.
Figure 5A:
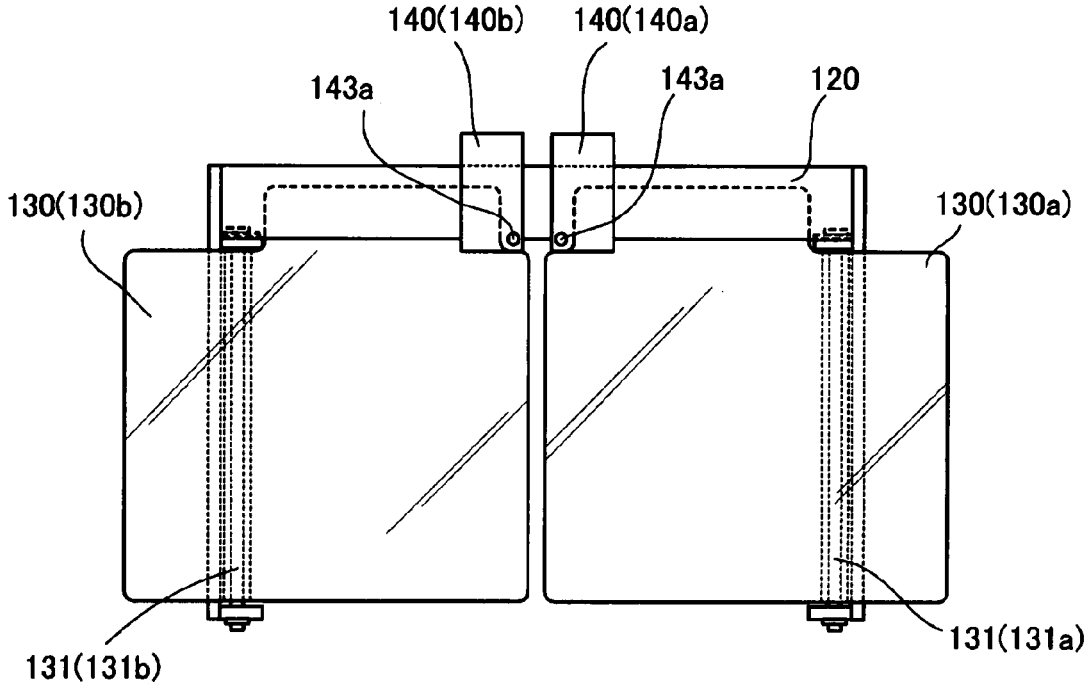
FIG. 5A is a plan view of a prize dispensing device.
Figure 5B:
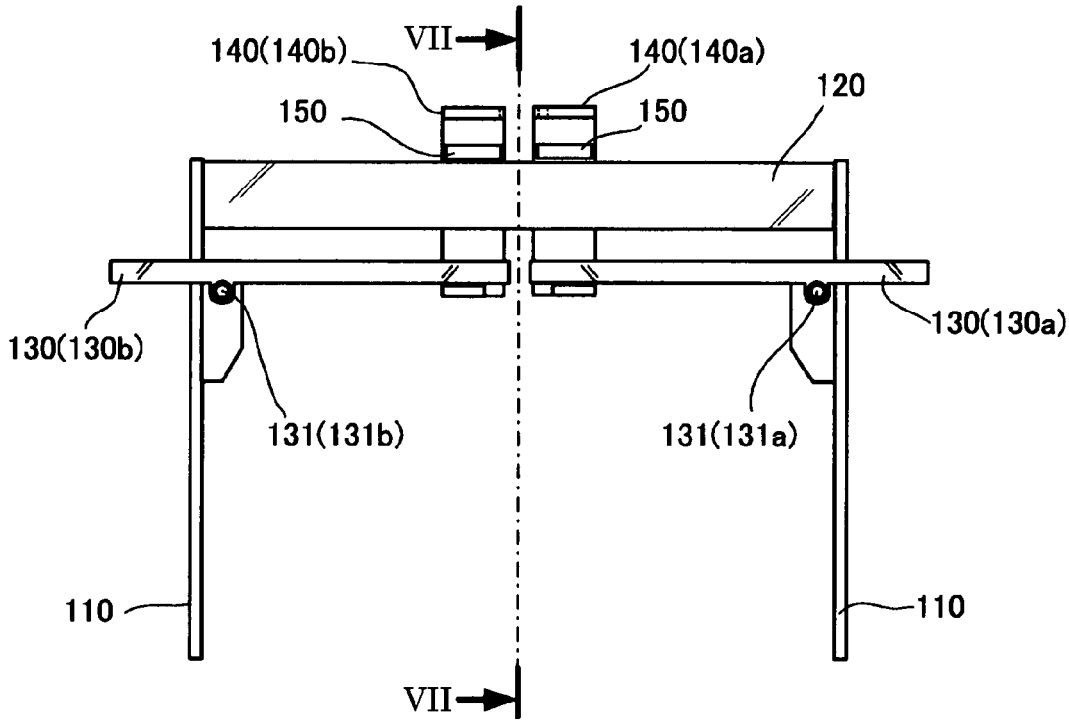
FIG. 5B is a front view of a dispensing device.

FIG. 4 is an oblique view of the prize dispensing device 100. FIG. 5A is a plan view of the prize dispensing device 100, and FIG. 5B is a front view of the prize dispensing device 100. As shown in FIGS. 3 to 5A and 5B, the prize dispensing device 100 includes frame members 110, a horizontal rod 120, the support plate 130, locking members 140, and the weight member 160.

The frame members 110 are made up a pair of flat plate members approximately in the shape of the letter "h" in plan view. The frame members 110 are provided so that the flat plate members are opposite to each other with upper ends 111 disposed in the inner part and lower ends 112 secured to the right and left inner surfaces of the prize receiving port 61. The horizontal rod 120 which is a thin square pillar is secured to the top ends 111 of the frame members 110 in a state in which the horizontal rod 120 is constructed so that the longitudinal direction coincides with the horizontal and right-and-left direction. Two locking members 140 are pivotally supported near the center of the horizontal rod 120. The support plate 130 is pivotally supported on the top surfaces of middle sections 113 of the frame members 110.

The support plate 130 is a flat plate formed of a transparent acrylic resin. The support plate 130 is pivotally supported on the top surface of the middle section 113 of the frame member 110 along an axis 131 of which the axial direction coincides with the horizontal and depth direction (back and forth direction) at a position near one end. Specifically, the support plate 130*a* is pivotally supported on the other end on the top surface of the middle section 113 of the frame member 110*a* along the axis 131*a* of which the axial direction coincides with the depth direction, and the support plate 130*b* is pivotally supported on the other end on the top surface of the middle section 113 of the frame member 110*b* along the axis 131*b* of which the axial direction coincides with the depth direction.

The support plate 130 is locked by being suspended on the locking member 140 at the other end so that the support plate 130 is maintained almost horizontally. Specifically, the support plate 130*a* is locked by the locking member 140*a*, and the support plate 130*b* is locked by the locking member 140*b*. The bonus prize P is placed on the top surface of the almost horizontal support plate 130.

The support plates 130 are formed to have a size which allows the other ends to be adjacently disposed at a short distance in a state in which the support plates 130 are almost horizontally locked by the locking members 140. This prevents the prize P placed on the top surface of the support plate 130 from being dropped into the prize receiving port 61 through the space between the support plates 130, and prevents the rotational movement of the support plate 130 around the axis 131 from being hindered. In order to prevent interference with a suspended string 161 which connects the locking member 140 and the weight member 160, a notch 132 in which the suspended string 161 moves freely is formed in the support plate 130 at a position on the inner side of the other end.

Figure 6:
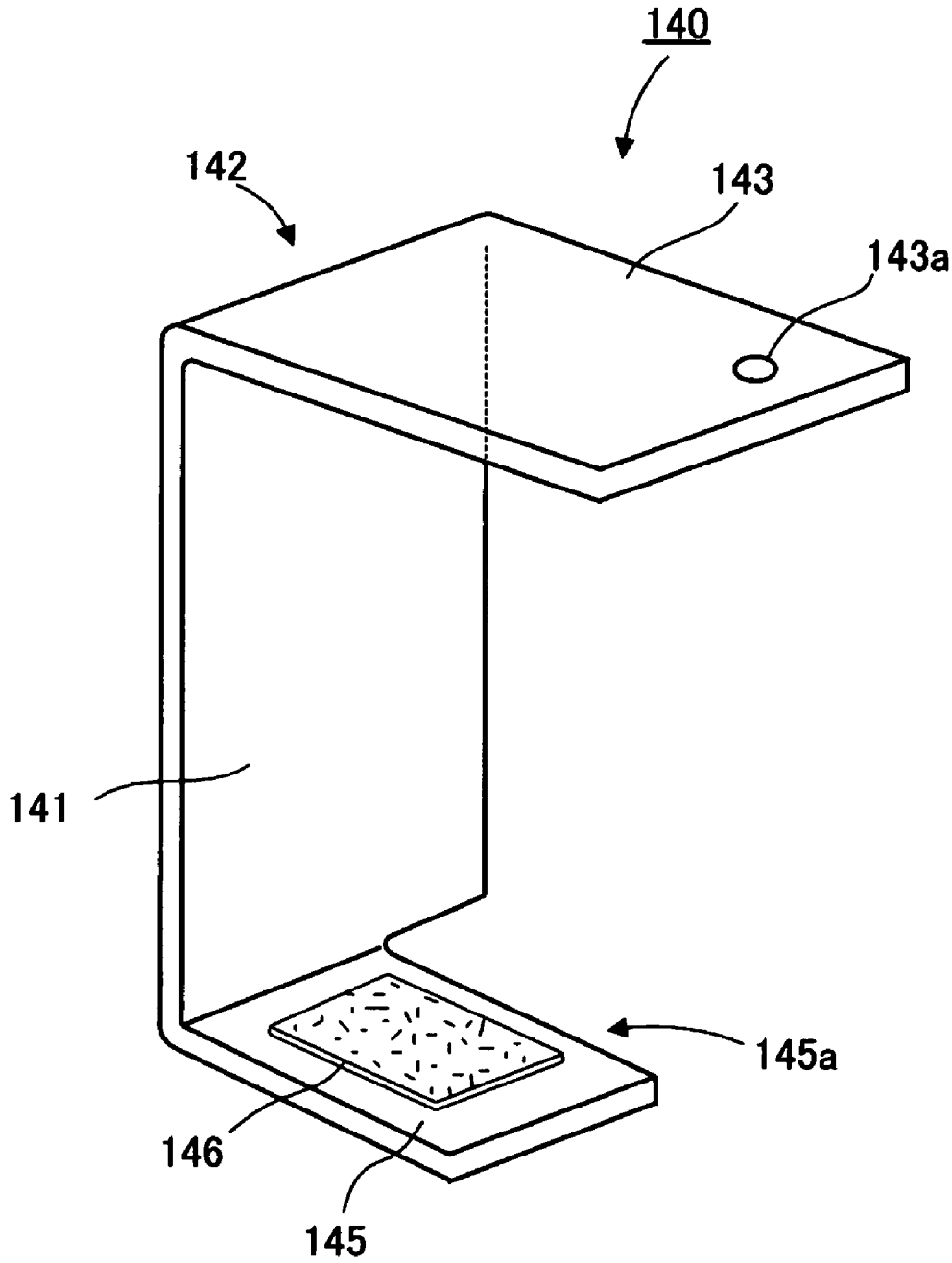
FIG. 6 is an oblique view of a locking member.

The locking member 140 is a member which locks the support plate 130, and is pivotally supported near the center of the horizontal rod 120. FIG. 6 is an oblique view of the locking member 140. As shown in FIG. 6, the locking member 140 is a member in the shape of the letter "C" in cross section formed by bending both ends of a flat plate in the same direction.

A string hole 143*a* for tying the suspended string 161 is formed in an upper portion 143 of the locking member 140. A notch 145 which almost coincides with the notch 132 in the support plate 130 and in which the suspended string 161 tied to the string hole 143*a* freely moves is formed in a lower portion 145 on the side opposite to the string hole 143*a* in the upper portion 143. Since the locking member 140 shown in FIG. 6 is the left locking member 140*b*, the string hole 143*a* is formed on the right of the upper portion 143, and the notch 145*a* is formed on the right of the lower portion 145. In the right locking member 140*a*, the string hole 143*a* is formed on the left of the upper portion 143, and the notch 145*a* is formed on the left of the lower portion 145.

A skidproof member 146 which prevents the end of the support plate 130 from skidding adheres to the top surface of the lower portion 145. The skidproof member 146 is a member formed in the shape of a sheet using rubber, polyurethane, or the like.

The locking member 140 is rotatably secured to the back surface of the horizontal rod 120 using a hinge 150 with the upper portion 143 positioned on the upper side and the lower portion 145 positioned on the lower side at a position inside a center portion 141 of the C-shape near an upper bent portion 142. The hinge 150 is provided in a state in which the axial direction is along the horizontal and right-and-left direction so that the locking member 140 can move rotationally toward the front side (or in the depth direction).

One end of the suspended string 161 is tied to the string hole 143*a* in the upper portion 143. The suspended string 161 moves freely through the notch 132 in the support plate 130 and the notch 145*a* in the lower portion 145 of the locking member 140. The other end of the suspended string 161 is tied to the weight member 160 on the stationary table 31. The other end of the support plate 130 is placed on and locked by the top surface of the lower portion 145. The locking member 140 is formed so that the height of the lower portion 145 is almost equal to the height of the axis 131 of the support plate 130 in a state in which the locking member 140 is secured to the horizontal rod 120, thereby locking the support plate 130 almost horizontally.

Figure 7A:
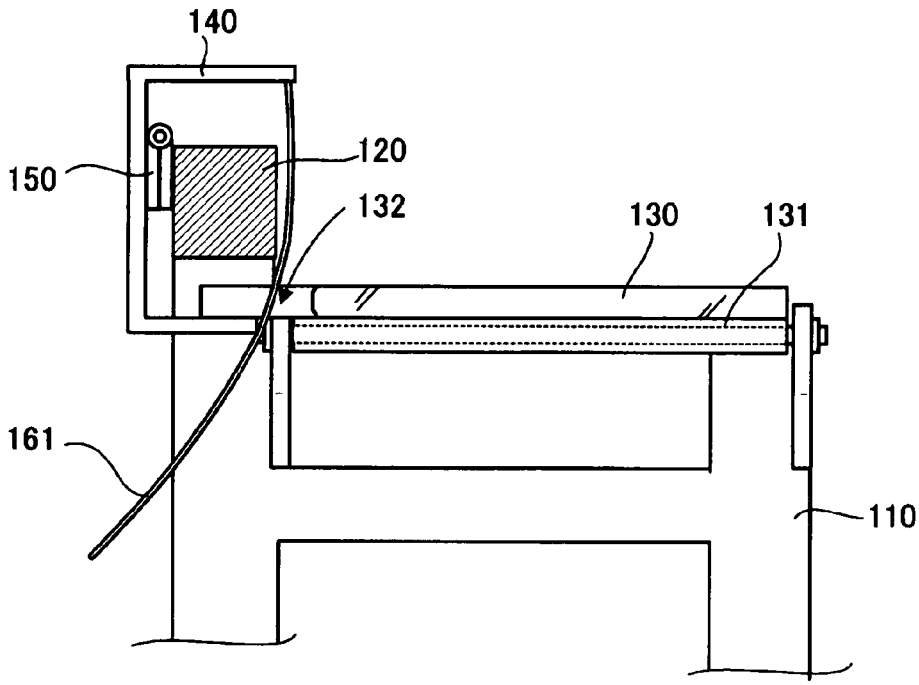
FIG. 7A is a view illustrative of the operation of a prize dispensing device showing a state before the operation.
Figure 7B:
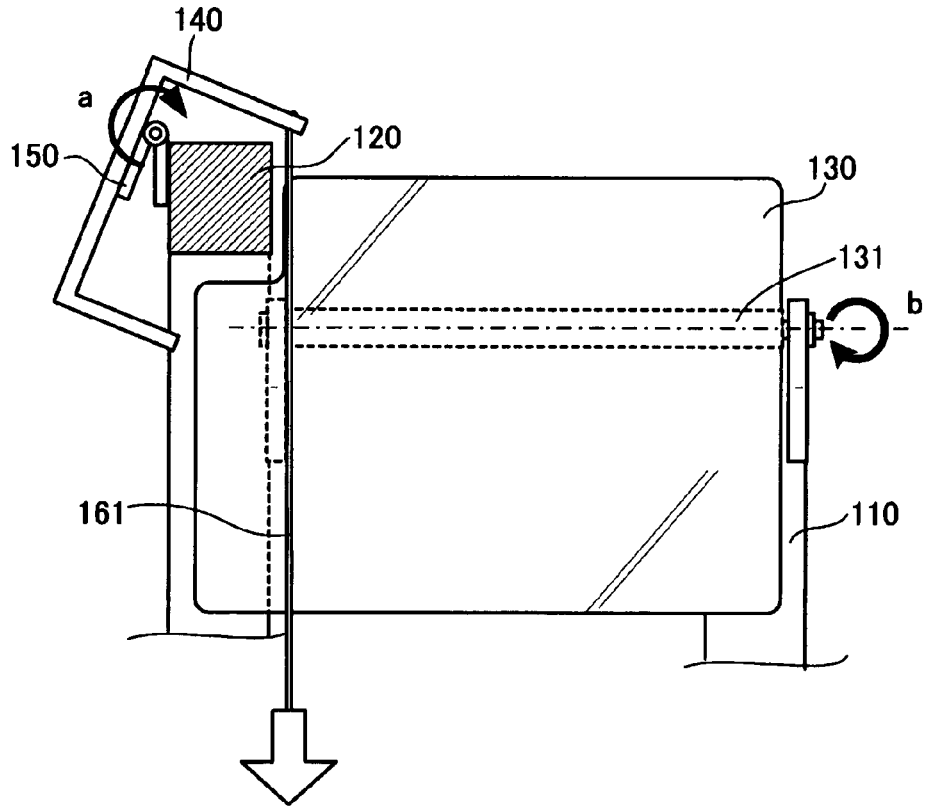
FIG. 7B is a view illustrative of the operation of a prize dispensing device showing a state after the operation.

FIGS. 7A and 7B are views illustrative of the operation of the prize dispensing device. FIGS. 7A and 7B are enlarged views of the main portion near the locking member 140 in FIGS. 5A and 5B. In FIG. 7A, the locking member 140 stands still in a balanced manner, and the other end of the support plate 130 is placed on the top surface of the lower portion 145 of the locking member 140 so that the support plate 130 is held almost horizontally. In this case, the center portion 141 of the locking member 140 is almost vertical, and the locking member 140 locks the support plate 140 at a position almost directly under the hinge 150 which is the rotational axis of the locking member 140. Specifically, the lower portion 145 is positioned on the lowermost end of the swing (i.e. swing of the locking position of the support plate 130) when the locking member 140 moves rotationally. In this case, the locking member 140 can lock the support plate 130 most stably.

The suspended string 161 tied to the string hole 143*a* in the upper portion 143 is suspended downward through the notch 132 in the support plate 130 and the notch 145*a* in the locking member 140, and the weight member 160 to which the other end of the suspended string 161 is tied is placed on the stationary table 31.

When the weight member 160 drops from the stationary table 31 by being pushed by the prize P or the like, the upper portion 143 of the locking member 140 is pulled downward due to the weight of the weight member 160, whereby the locking member 140 moves rotationally toward the front side (direction indicated by an arrow a). Specifically, the locking member 140 moves rotationally so that the lower portion 145 moves upward. As a result, the other end of the support plate 130 suspended on the lower portion 145 is displaced, whereby the support plate 130 moves rotationally so that the other end moves downward (direction indicated by an arrow b). This causes the almost horizontal support plate 130 to be almost vertical, whereby the prize P placed on the top surface of the support plate 130 falls toward the prize receiving port 61.

<Effects>

In the pusher-type prize dispensing device 100 according to this embodiment, each of the two support plates 130 on which the bonus prize P is placed is pivotally supported on one end on the axis 131 of which the axial direction coincides with the horizontal and depth direction, and is locked almost horizontally by allowing the other end to be suspended on the locking member 140. The locking member 140 is in the shape of the letter "C" in cross section. The locking member 140 is pivotally supported at the center of the C-shape. The suspended string 161 is tied to the bent upper portion 143, and the other end of the support plate 130 is suspended on the top surface of the lower portion 145, whereby the locking member 140 locks the support plate 130. When the weight member 160 falls from the stationary table 31, the locking member 140 moves rotationally due to the fall of the weight member 160 so that the upper portion 143 moves downward, and the support plate 130 moves rotationally so that the end suspended on the top surface of the lower portion 145 moves downward, whereby the prize P placed on the top surface of the support plate 130 falls toward the prize receiving port 61. Specifically, when the weight member 160 falls from the stationary table 31, the locking member 140 which locks the support plate 130 moves rotationally so that the lock is released, whereby the support plate 130 moves rotationally so that the prize P placed on the support plate 130 is dispensed to achieve a novel dispensing operation of the prize P.

<Modification>

The application of the invention is not limited to the above embodiments. Various modifications and variations may be made within the spirit and scope of the invention.

(A) Locking Member 140

In the above embodiment, the support plate 130 is locked almost horizontally. Note that the support plate 130 may be locked in an inclined state. In more detail, the locking member 140 is formed as shown in FIGS. 8A and 8B, for example.

Figure 8A:
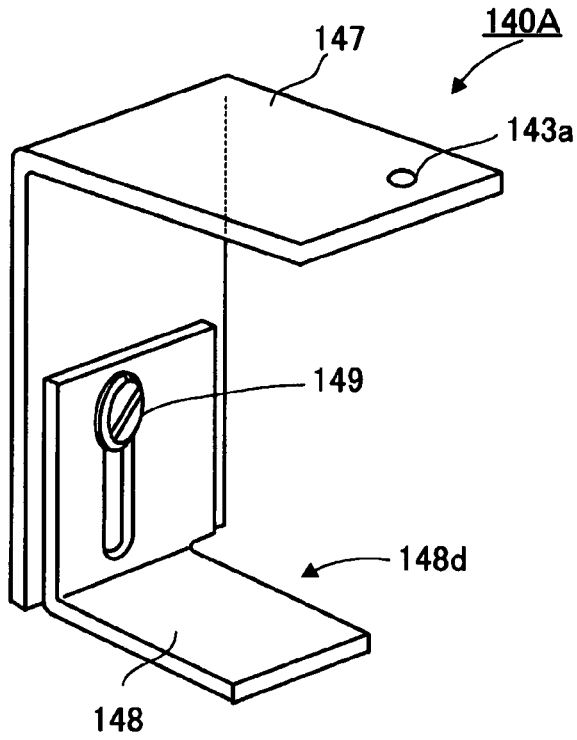
FIG. 8A is a modification of a locking member.
Figure 8B:
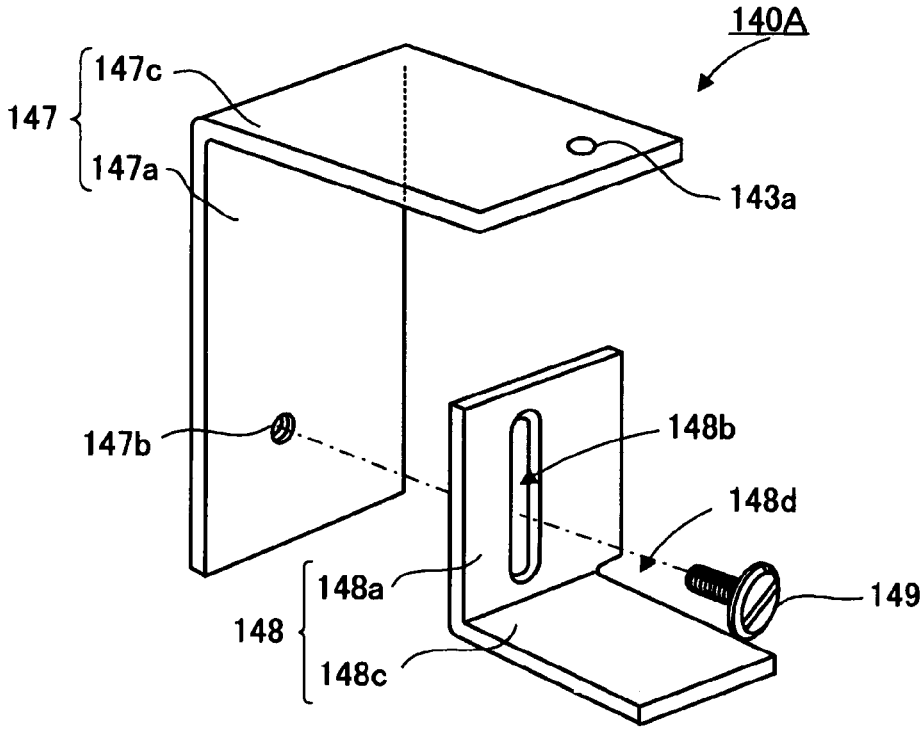
FIG. 8B is a modification of a locking member.

FIG. 8A is an oblique view of a locking member 140A which is another configuration example of the locking member 140, and FIG. 8B is an exploded oblique view of the locking member 140A. In FIGS. 8A and 8B, the locking member 140A is formed of two members, i.e., a stationary portion 147 and a movable portion 148 in the shape of the letter "L" in cross section.

The stationary portion 147 corresponds to the center portion 141 and the upper portion 143 of the locking member 140. The string hole 143*a* is formed in an upper portion 147*c*, and a screw hole 147*b* is formed in a center portion 147*a*. The movable portion 148 corresponds to the center portion 141 and the lower portion 145 of the locking member 140. A notch 148*d* is formed in the lower portion 148*c*, and a long hole 148*b* is formed in the center portion 148*a* along the longitudinal direction. A screw 149 passes through the long hole 148 in the movable portion 148 from the inside of the L-shape and is inserted into the screw hole 147*b* in the stationary portion 147, whereby the movable portion 148 is secured to the stationary portion 147.

In this case, the position and the angle of the movable portion 148 with respect to the stationary portion 147 can be changed by changing the position in the long hole 148*b* and the angle at which the movable portion 148 is screwed. Specifically, the distance and the angle between the upper portion 147*c* and the lower portion 148*c* can be changed.

The locking member 140A configured as described allows the locking height of the support plate 130 to be changed, that is, allows the support plate 130 to be locked in an inclined state so that the other end is inclined toward the center of the prize receiving port 61. In this case, it is preferable that the angle of the stationary portion 147 with respect to the movable portion 148 correspond to the inclination of the support plate 130.

(B) Shape of Support Plate 130

In the above embodiment, the support plate 130 is a flat plate. For example, the support plate 130 may be a member which is convexly curved downward such as a member in the shape of the letter "V", or "U" in cross section. The support plate 130 may be a container which is formed convexly downward.

(C) Pivotal Support of Locking Member 140

In the above embodiment, the locking member 140 is pivotally supported on the horizontal rod 120 using the hinge 150. Note that the locking member 140 may be pivotally supported using another member such as a torsion spring. In this case, the locking state of the support plate 130 can be more stably maintained by allowing the stress (torsion force) of the torsion spring to act in the direction in which the locking state of the support plate 130 is maintained.

(D) Locking Two Support Plates 130 by One Locking Member 140

In the above embodiment, the two support plates 130 are independently locked by the locking members 140. Note that the two support plates 130 may be locked by one locking member 140. In this case, when the weight member 160 falls from the stationary table 31, the locking member 140 coupled to the weight member 160 moves rotationally so that the lock of the two support plates 130 is released. This causes the two support plates 130 to move rotationally, whereby the prize P placed thereon falls toward the prize receiving port 61.

(E) Locking One Support Plate 130 by a Plurality of Locking Members 140

One support plate 130 may be locked by a plurality of locking members 140. In this case, the support plate 130 moves rotationally when all the weight members 160 coupled to the respective locking members 140 fall from the stationary table 31, whereby the prize P placed thereon falls.

(F) Rotational Movement of Locking Member 140

In the above embodiment, the locking member 140 moves rotationally so that the upper portion 143 of the locking member 140 is pulled and moves downward due to the fall of the weight member 160 coupled to the upper portion 143 of the locking member 140 from the stationary table 31, whereby the lock of the support plate 130 is released. Note that the locking member 140 moves rotationally to release the lock of the support plate 130 using another configuration.

Figure 9:
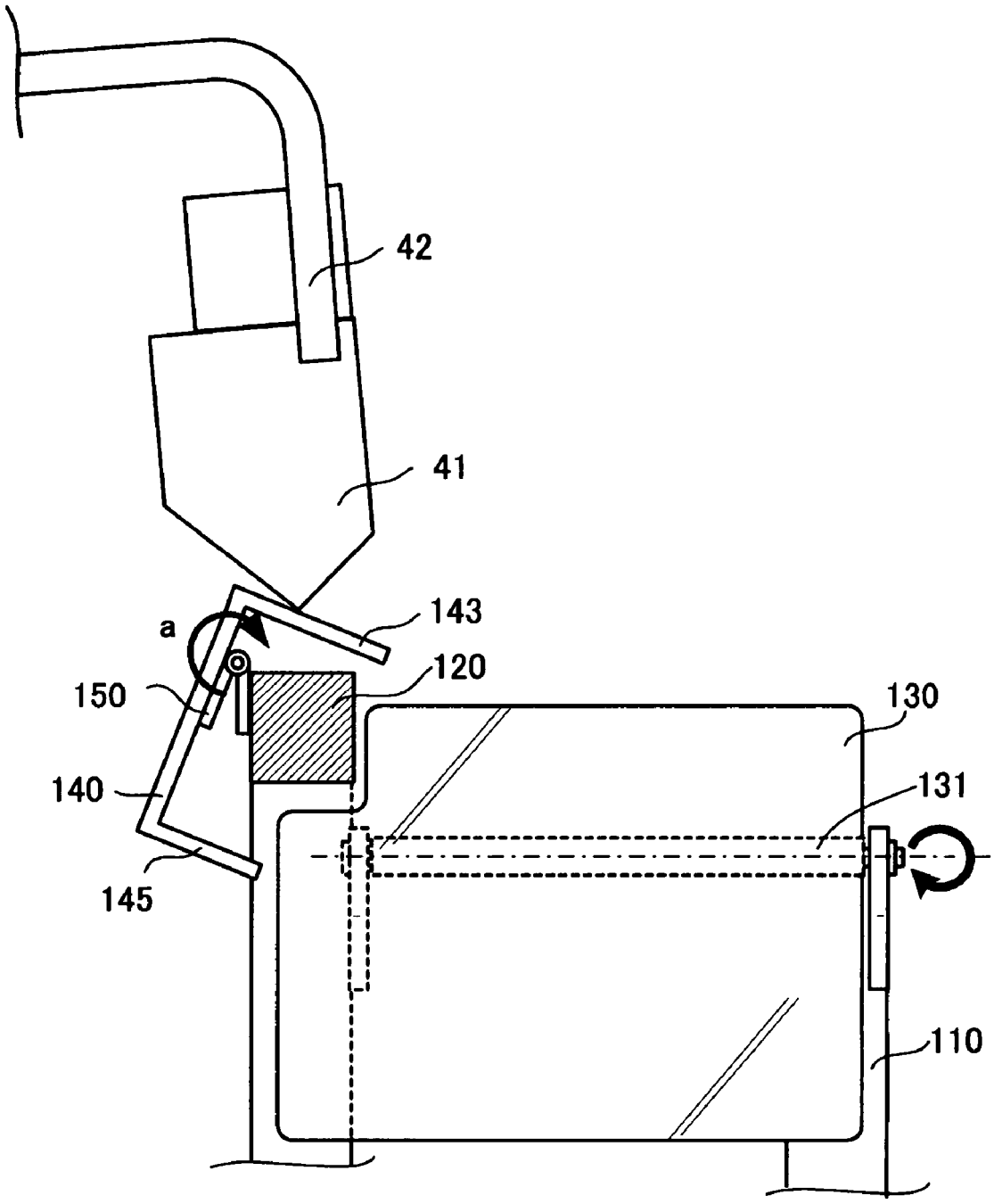
FIG. 9 is a modification of rotational movement of a locking member.

For example, as shown in FIG. 9, the JP box 41 of the JP dispensing device 40 may apply external force to the upper portion 143 of the locking member 140 to cause the locking member 140 to move rotationally. Specifically, when the support arm 42 inclines toward the front side (player side) when specific JP conditions have been satisfied so that the JP box 41 moves downward from the upper position to the lower position, the bottom portion of the JP box 41 touches the top surface of the upper portion 143 of the locking member 140 and presses (applies external force) the upper portion 143 downward. This causes the locking member 140 to move rotationally so that the upper portion 143 moves downward, whereby the lock of the support plate 130 is released.

Although only some embodiments of the invention have been described above in detail, those skilled in the art would readily appreciate that many modifications are possible in the embodiments without materially departing from the novel teachings and advantages of the invention. Accordingly, such modifications are intended to be included within the scope of the invention.

What is claimed is:

1. A prize dispensing mechanism used for a pusher-type game device which dispenses a prize which has been pushed from a stationary table and falls into a prize receiving port, the prize dispensing mechanism comprising:

a support plate for placing the prize, the support plate having an end and being pivotally supported on a first axis;

a locking member, having two ends, pivotally supported on a second axis and having on one of the two ends a suspension section on which the end of the support plate is suspended, the locking member preventing downward rotational movement of the support plate by allowing the support plate to be suspended on the suspension section when the suspension section is located at a lowermost end of a rotational movement swing; and an external force applying mechanism which applies external force to the other of the two ends of the locking member;

wherein the locking member moves rotationally when the external force is applied to the other end of the locking member by the external force applying mechanism to unlock the locking member, whereby the support plate moves rotationally and the prize placed on the support plate falls.

2. The prize dispensing mechanism as defined in claim 1, wherein the external force applying mechanism includes a weight member which is coupled to the other of the two ends of the locking member and is placed on the stationary table; and wherein force occurring when the weight member falls from the stationary table is transmitted to the other of the two ends of the locking member, whereby the locking member moves rotationally.

3. The prize dispensing mechanism as defined in claim 2, wherein the second axis is a horizontal axis pivotally supporting the locking member in a state in which the one of the two ends is positioned on a lower side and the other of the two ends is positioned on an upper side; and a notch is formed in the suspension section in which a suspended string which connects the other of the two ends and the weight member moves freely.

4. The prize dispensing mechanism as defined in claim 1, wherein the second axis is a horizontal axis pivotally supporting the locking member in a state in which the one of the two ends is positioned on a lower side and the other of the two ends is positioned on an upper side, and the locking member moves rotationally so that the suspension section provided on the one of the two ends moves due to external force applied to the other of the two ends.

5. The prize dispensing mechanism as defined in claim 1, wherein the locking member is formed so that height of the suspension section can be changed.

6. The prize dispensing mechanism as defined in claim 1, wherein the locking member includes a skidproof member provided in a contact section of the suspension section with the support plate.

7. The prize dispensing mechanism as defined in claim 1, comprising:

a plurality of the support plates;

wherein the locking member locks the support plates, and the prizes placed on the support plates fall when the lock is released.

8. The prize dispensing mechanism as defined in claim 1, comprising:

a plurality of the locking members;

wherein the support plate moves rotationally when the locks of all of the locking members are released, whereby the prize placed on the support plate falls.

9. A pusher-type game device which dispenses a prize which has been pushed from a stationary table and falls into a prize receiving port, the game device comprising:

a support plate for placing the prize, the support plate having an end and being pivotally supported on a first axis;

a locking member, having two ends, pivotally supported on a second axis and having on one of the two ends a suspension section on which the end of the support plate is suspended, the locking member preventing downward rotational movement of the support plate by allowing the support plate to be suspended on the suspension section when the suspension section is located at a lowermost end of a rotational movement swing;

a prize box which can store the prize therein; and a support arm which supports the prize box on one end and is pivotally supported on the other end, the support arm being able to transition between an upright state and an inclined state;

wherein the support arm rotates and inclines so that the prize box touches the other of the two ends of the locking member to apply external force, whereby the locking member moves rotationally to unlock the locking member so that the support plate moves rotationally, whereby the prize placed on the support plate falls.

10. The game device as defined in claim 9, further comprising:

a control section which controls rotation of the support arm.

* * * * *